US005843324A

United States Patent [19]

Shirley

[11] Patent Number: 5,843,324

[45] Date of Patent: Dec. 1, 1998

[54] REUSABLE FORM

[76] Inventor: Brett L. Shirley, 4802 N. Riverside Rd., Attica, Ind. 47918

[21] Appl. No.: 838,865

[22] Filed: Apr. 11, 1997

[51] Int. Cl.[6] ..... E04G 15/02

[52] U.S. Cl. ..... 249/39; 249/177; 249/185

[58] Field of Search ..... 249/39, 170, 171, 249/172, 177, 185, 188

[56] References Cited

U.S. PATENT DOCUMENTS

| | | | |
|---|---|---|---|
| 746,051 | 12/1903 | Du Bois . | |
| 795,518 | 7/1905 | Lamp . | |
| 805,883 | 11/1905 | Russell . | |
| 1,244,937 | 10/1917 | Zagelmeyer . | |
| 2,163,222 | 6/1939 | Westcott . | |
| 2,602,983 | 7/1952 | Troiel . | |
| 2,658,252 | 11/1953 | Avril . | |
| 2,683,913 | 7/1954 | Honningford . | |
| 2,704,876 | 3/1955 | Puckett, Jr. et al. . | |
| 2,776,463 | 1/1957 | Lankford . | |
| 2,941,276 | 6/1960 | Goodlad . | |
| 3,092,887 | 6/1963 | Switzer | 249/39 |
| 3,163,909 | 1/1965 | Williams . | |
| 3,367,618 | 2/1968 | Masur . | |
| 3,517,906 | 6/1970 | Blonde | 249/39 |
| 3,995,843 | 12/1976 | Kasteler | 249/39 |
| 4,047,691 | 9/1977 | Wolf | 249/39 |
| 4,065,540 | 12/1977 | Okami . | |
| 4,138,084 | 2/1979 | Reid | 249/39 |
| 4,159,098 | 6/1979 | Wong . | |
| 4,666,388 | 5/1987 | Kovasna et al. . | |
| 4,706,927 | 11/1987 | Lawall . | |
| 4,969,626 | 11/1990 | Strauch . | |
| 5,169,544 | 12/1992 | Stanfill et al. . | |
| 5,444,947 | 8/1995 | Miller . | |
| 5,458,828 | 10/1995 | Chuang | 249/39 |
| 5,634,302 | 6/1997 | Lee | 249/39 |

OTHER PUBLICATIONS

Monarch Windows Brochure, undated.

*Primary Examiner*—James P. Mackey

*Attorney, Agent, or Firm*—Woodard, Emhardt, Naughton, Moriarty & McNett

[57] ABSTRACT

A form for establishing an opening in a wall poured between a first wall form and a second wall form in a wall. In one embodiment the form comprises a substantially rigid body having an outwardly extending portion at each end for forming a recess adjacent the opening and having a supporting member for suspending the form from the wall forms. In an alternate form of the present invention, the wall form is defined by a collapsible wall form that folds inwardly from the poured wall's opening to allow for the easy removal of the form from the wall. In another embodiment of the present invention the form has an adjustable member for changing the depth that the form extends from the top of the wall forms.

10 Claims, 4 Drawing Sheets

REUSABLE FORM

BACKGROUND OF THE INVENTION

The present invention relates generally to an apparatus for forming an opening in a wall constructed of a flowable building material. More particularly, one embodiment of the present invention defines a reusable form for establishing an opening having a channel portion within a wall poured of concrete. While, the present invention was developed for use in the building industry, certain applications may be outside of this field.

It is a common practice in the building industry to pour a wet flowable building material into a set of forms in order to produce the footings, foundation, walls and/or other portions of a building. There are many instances in which it is desirable for the building wall to contain a vent, window, door or other openings therein. A generally accepted method of establishing the opening within the wall is to position a barrier within the wall forms so that the desired opening is formed in the wall during the pouring of the flowable building material. After the flowable building material has solidified, the forms are removed so as to leave the wall with an opening therein for receiving a piece of hardware such as a beam, a vent, a door, and/or a window.

One method currently utilized in the building industry to establish a barrier within the wall forms in order to create an opening in the poured wall is to construct at the job site an aperture form while the wall forms are being erected. The building of the aperture form at the job site has typically been relatively expensive, at least in part due to the necessity of using skilled labor to insure the dimensional accuracy of the forms. Further, the cost associated with the prior aperture forms has generally not been recoverable over multiple jobs because the aperture forms are typically destroyed during their removal from the poured walls.

Even with a variety of earlier aperture forming methods there remains a need for a reusable aperture form for establishing an opening in a wall formed from pourable building material. The present invention satisfies this need in a novel and unobvious way.

SUMMARY OF THE INVENTION

One embodiment of the present invention contemplates an apparatus positionable between a first and second wall form to create an opening in the wall which is poured of a flowable building material. The apparatus comprising: a reusable body member having a pair of spaced outer surfaces extending between the first and second wall forms and a bottom outer surface for preventing the receipt of the flowable building material within the space defined by the body member; the pair of spaced outer surfaces each having an outwardly extending portion for forming a substantially vertical recess in the wall contiguous with a portion of the opening in the wall; and, a supporting member coupled to the body member and extending between the first and second wall form for coupling the body member to at least one of the first and second wall forms, the member for receiving a clamping load to hold the body member in a substantially fixed position relative to the first and second wall forms during the pouring of the wall.

Another embodiment of the present invention contemplates an apparatus positionable between a first and second wall form to establish an opening in the wall which is poured of a flowable building material. The apparatus comprising: a reusable member having a pair of end walls and a bottom wall extending therebetween, each of the walls extending between the first and second wall forms for preventing the receipt of the flowable building material within the volume defined by the reusable member; the bottom wall having a first portion and a second portion hingedly coupled thereto; the pair of end walls being spaced from one another and each of the pair of end walls having an outwardly extending portion for creating a recess as part of the opening in the wall, one of the pair of end walls being hingedly coupled to the first portion of the bottom wall and the other of the pair of end walls being hingedly coupled to the second portion of the bottom wall; and, the reusable member having a substantially rigid opening forming mode for forming the opening in the wall and a contracted mode wherein the pair of end walls and the portions of the bottom wall are disposed inwardly from the opening forming mode for facilitating the removal of the member from the wall.

One object of the present invention is to provide an improved reusable form for establishing an opening in a cast wall.

Related objects and advantages of the present invention will be apparent from the following description.

DESCRIPTION OF THE PREFERRED EMBODIMENT

Figure 1:
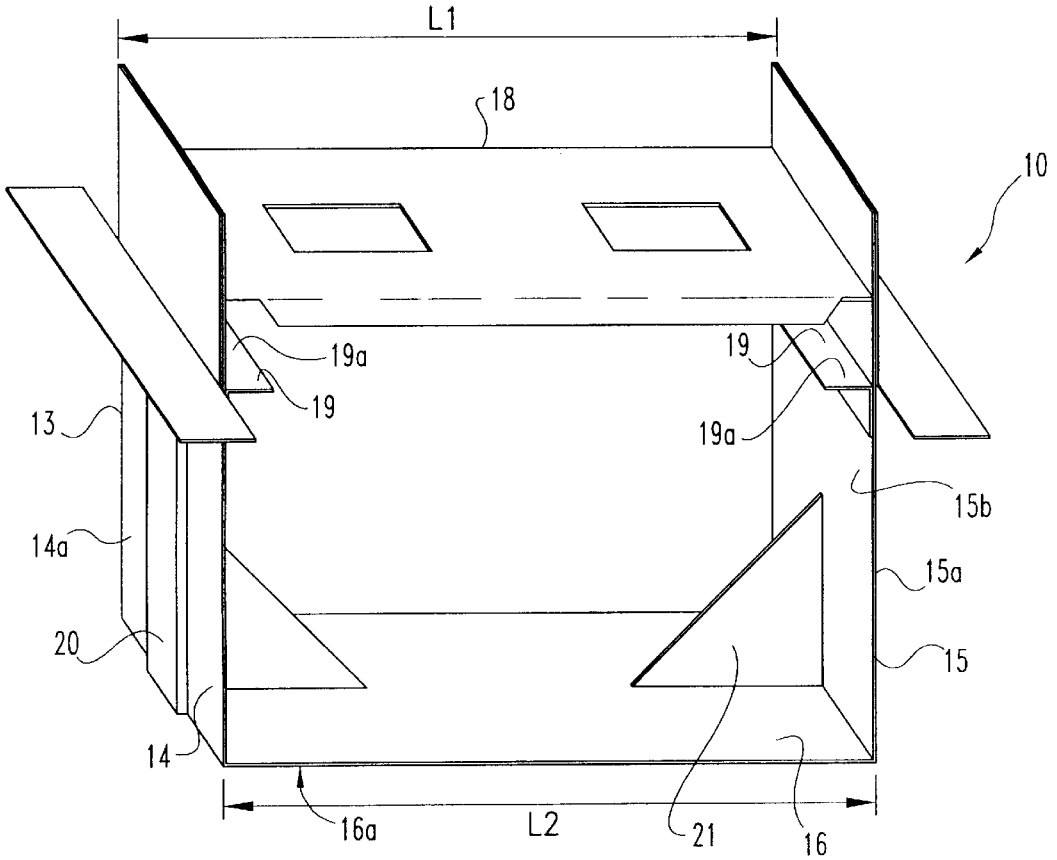
FIG. 1 is a perspective view of an opening form for establishing an opening in a poured wall according to one embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
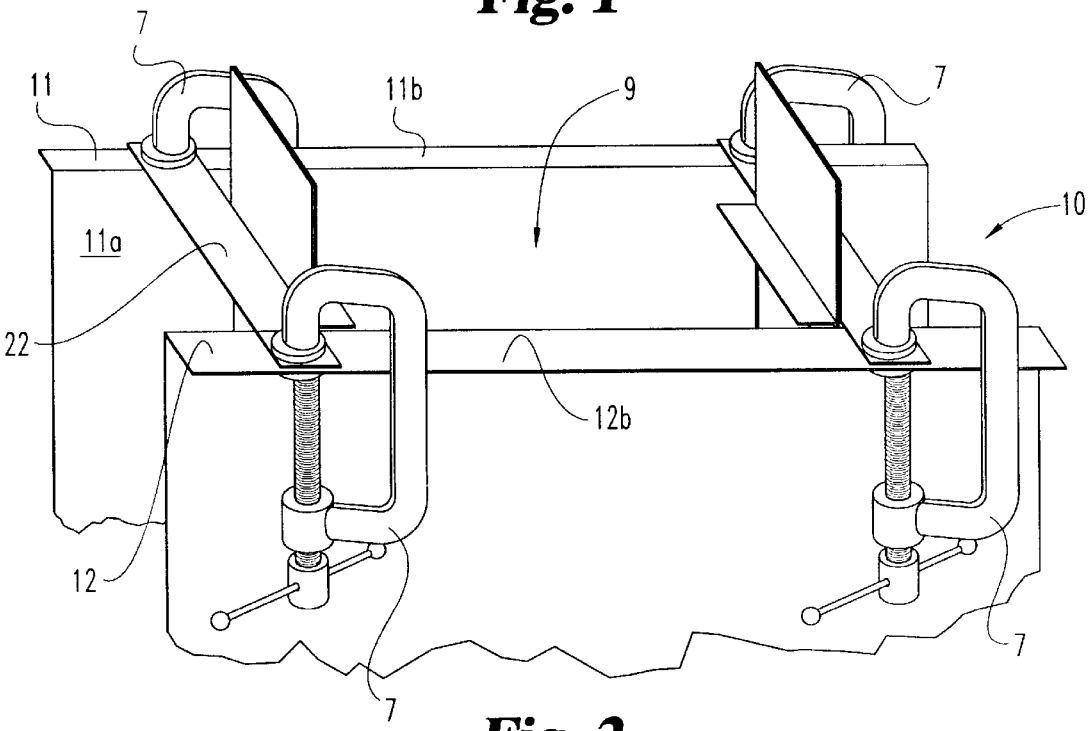
FIG. 2 is a perspective view of the FIG. 1 opening form coupled between a pair of spaced wall forms.

With reference to FIGS. 1 and 2, there is illustrated a perspective view of a reuseable form 10 utilized for establishing an opening 40 (FIG. 4) in a wall 41 formed of a flowable building material. The form 10 is designed and constructed to be utilized to establish the opening 40 in the wall formed between a pair of spaced wall forms 11 and 12. In the preferred embodiment the wall forms 11 and 12 are reuseable metallic forms, however other types of wall forms are contemplated herein, such as but not limited to wood forms and rigid foam forms. The form 10 defines a volume 9 within the space between the first wall form 11 and the second wall form 12 that does not receive the flowable building material therein. The form 10 can be made in a variety of widths for use with walls of different thicknesses, such as but not limited to six, eight, ten, or twelve inches. It is understood herein that the term flowable building material includes, but is not limited to, concrete and other similar material that are typically used in the creation of poured foundations and walls.

The form 10 having a body member 13 that comprises a pair of spaced end walls 14 and 15 that are positionable within the wall forms 11 and 12 so as to prevent the passage of the flowable building material into volume 9. Spanning between the pair of spaced end walls 14 and 15 is a bottom wall 16 for preventing the passage of the flowable building material into volume 9. Further, each of the end walls 14, 15 and the bottom wall 16 having an outer surface 14*a*, 15*a* and 16*a* respectively that is abutted by the flowable building material during the formation of the wall. In one embodiment the body member 13 being formed of a continuous piece of metal plate that has been bent such that the end walls 14 and 15 are substantially perpendicular to the bottom wall 16. In the preferred form of body member 13 the end walls 14 and 15 are formed at a slight draft angle to the bottom wall 16. In one embodiment the distance L2 being less than the distance L1, and in a preferred embodiment the difference of L1–L2 is about one eighth inches (⅛). The body member 13 having sufficient thickness and structural integrity to resist deformation and collapsing under the load of the flowable building material.

The first end wall 14, the second end wall 15, and the bottom wall 16 extend between and contact a portion of the interior surface 11*a* of first wall form 11, and a portion of the interior surface (not illustrated) of the second wall form 12. The engagement of the respective edges of the walls with the wall forms 11 and 12 provides a seal suitable for minimizing the leakage of the flowable building material into volume 9. In one form of the present invention a removable brace 18 extends between an inner surface (not illustrated) of the first end wall 14 and an inner surface 15*b* of the second end wall 15 to add structural rigidity, and for preventing the collapse of the form 10 upon being subjected to the loads associated with the wet flowable building material. In the preferred embodiment the brace 18 is a formed sheet metal member having stiffening ribs at it's edges, however other braces are contemplated herein including but not limited to metal plates and wood braces. A brace receiving member 19 is coupled to each of the end walls 14 and 15 for receiving and supporting the brace 18 within the body member 13. In the preferred embodiment the brace receiving member 19 having a planar portion 19*a* for allowing the brace 18 to rest thereon.

A wall recess forming portion 20 projects outwardly from each of the end walls 14 and 15 to establish a recess portion contiguous with the opening 40 in the wall 41. In one embodiment of the present invention, the wall recess forming portion 20 comprises a plate coupled to each of the end walls. However, other means for creating the wall forming recess portion 20 are contemplated herein, such as but not limited to locally deforming the end walls 14 and 15. One function of the wall recess forming portion 20 is to establish a groove, a channel, or other type of recess in the wall which is formed from the flowable building material. In a preferred embodiment the recess forming portion 20 defines a substantially vertical element. A preferred shape for the recess forming portion 20 is rectangular, and the recess forming portion in one embodiment is positioned mid span on each of the end walls 14 and 15. It is understood herein that the wall recess forming portion 20 can have a variety of shapes and locations, and the shape and location in the figures is not intended to be limiting. Additional static structure such as gussets 21 can be provided between each of the end walls 14 and 15 and the bottom wall 16 to increase the structural rigidity of the form 10.

A clamping load transfer member 22 is connected to each of the end walls 14 and 15 and extends between the first wall form 11 and the second wall form 12. In one form of the present invention the clamping load transfer member 22 extends beyond the pair of spaced wall forms 11 and 12. The clamping load transfer member 22 having sufficient strength and structural integrity to allow for the suspension of the form 10 from the wall forms 11 and 12 and to hold the body member 13 in a substantially fixed position relative to the wall forms 11 and 12 during the pouring and solidification of the wall 41. In one form of the present invention a clamp 7 is utilized to apply a static clamping load between the clamping load transfer member 22 and a flange on at least one of the wall forms. It is preferred that the clamp 7 be of the type to apply a clamping load without substantially damaging the wall forms 11 and 12. While FIG. 2 illustrates the clamping load being applied at four locations on the clamping load transfer members 22, it is understood herein that the clamping of the clamping load transfer members 22 to the wall forms 11 and 12 only requires clamping of the form 10 to each of the wall forms. Further, in an alternative embodiment the form 10 can be held in place by an object having sufficient weight to maintain the form within the wall forms.

Figure 3:
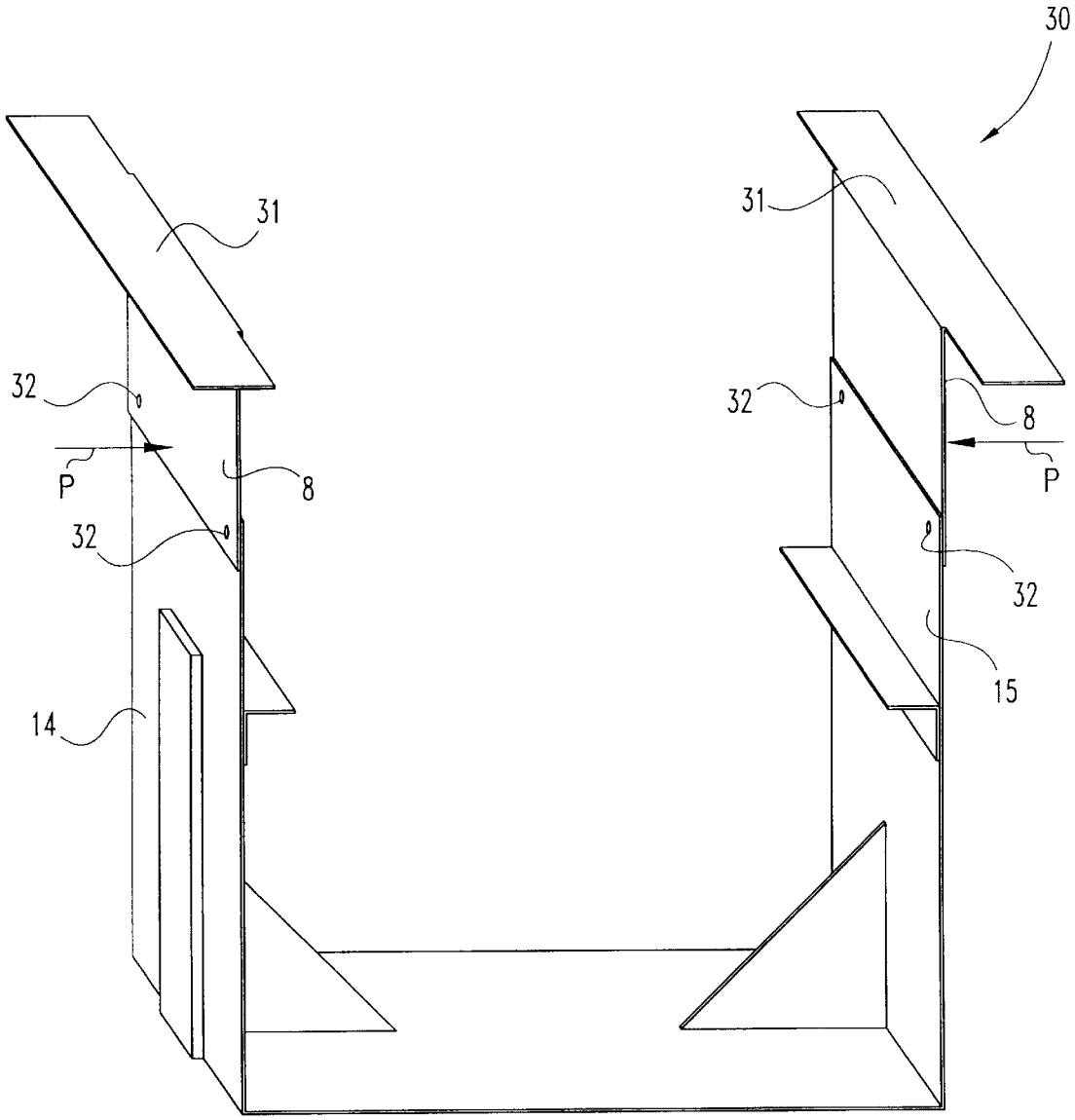
FIG. 3 is a perspective view of an alternative embodiment of the opening form comprising an adjustable coupling member.

With reference to FIG. 3, there is illustrated an alternative embodiment of the present invention which is designated form 30. Form 30 is substantially identical to form 10, and like feature numbers will be utilized herein to represent like features in the forms. A clamping load transfer member 31 being coupled to each of the end walls 14 and 15 of form 30. The clamping load transfer member 31 being moveable so as to allow the varying of the vertical distance the form 30 extends between the wall forms 11 and 12. In one embodiment of form 30 the clamping load transfer member 31 being connected to a mounting plate 8 that is anchored by a pair of fasteners 32 to the end walls 14 and 15 of the form 30. Removal of the fasteners 32 and rotation of the mounting plate 8 one hundred and eighty degrees changes the vertical distance that form 30 extends beneath the top edge 11*b* and 12*b* of the wall forms 11 and 12 respectively. The ability to change the vertical distance that form 30 extends from the top 11*b* and 12*b* of the wall forms 11 and 12 allows for flexibility in using the form 30 with wall forms having different vertical heights for pouring different height walls. While the form 30 illustrated in FIG. 3 has only two discrete positions for varying the vertical distance the form extends from the top 11*b* and 12*b* of the wall forms, it is contemplated herein that the form 30 could be continuously adjustable.

Figure 4:
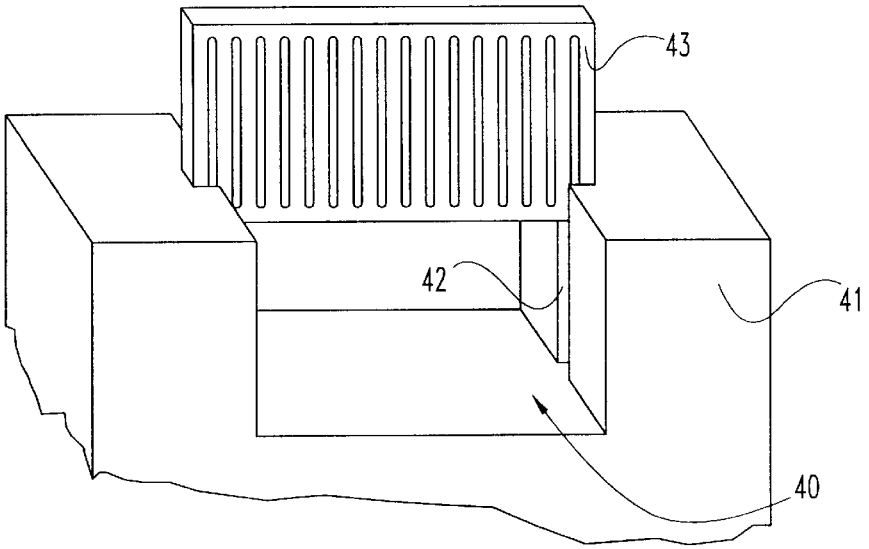
FIG. 4 is a perspective view of the poured wall with an opening therein as established by the FIG. 1 opening form, wherein the opening comprises a recess portion for receiving a piece of hardware therein.

Referring to FIG. 4, there is illustrated a perspective view of a portion of the wall 41 having an opening 40 therein that was established by the first wall form 11, the second wall form 12, and the aperture form of the present invention. While the opening 40 shown in FIG. 4, passes through the wall other embodiments of the present form contemplate an opening that does not pass through the wall and creates a recess. Opening 40 includes a pair of recess portions 42 for receiving an apparatus 43 therein. The opening 40 being of a near net shape, thereby not requiring any substantial finishing to be utilized for it's intended purpose. In a preferred embodiment the apparatus 43 defines a vent for use in a crawlspace wall. The form 10 or 30 being removeable from the portion of the wall 41 having opening 40 therein by applying an inward force in the direction of arrows P, which causes the walls 14 and 15 to deflect inwardly sufficiently to facilitate removal of the form. It is understood herein that the brace 18 must be removed prior to applying inward force P.

Figure 5:
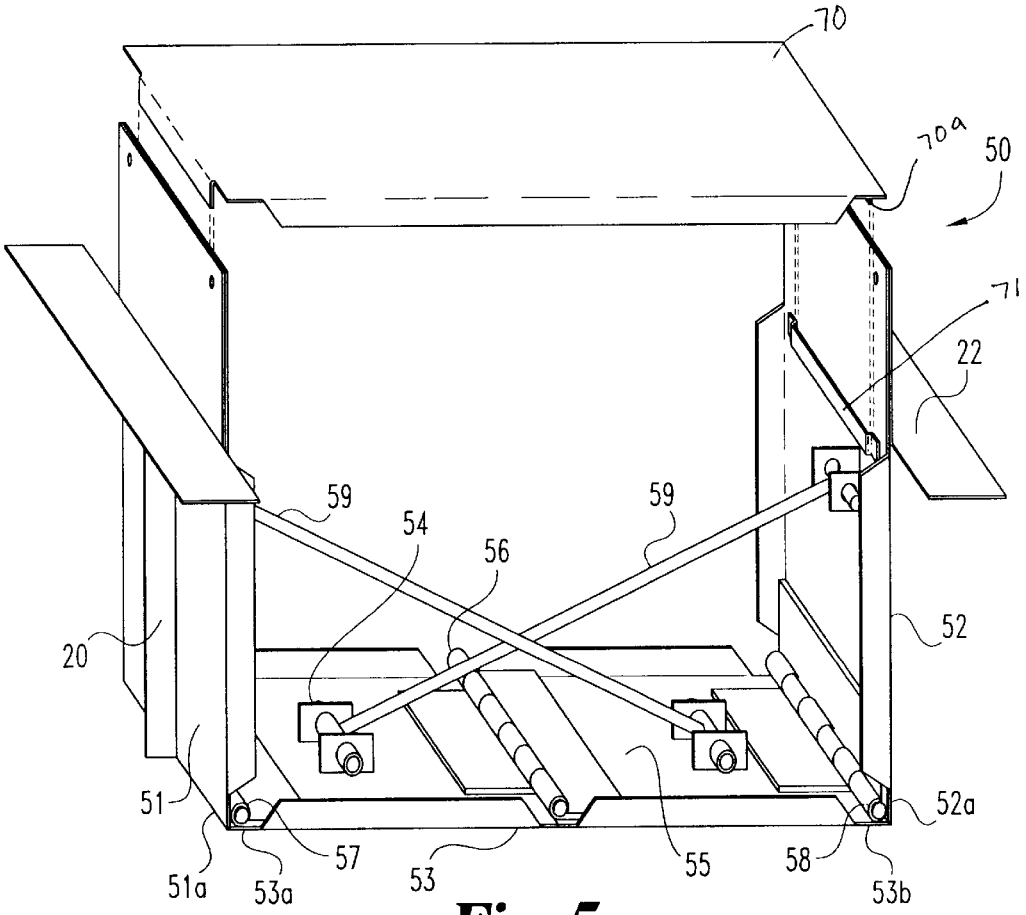
FIG. 5 is a perspective view of an alternative embodiment of the opening form in a substantially rigid state for establishing an opening in the poured wall.
Figure 6:
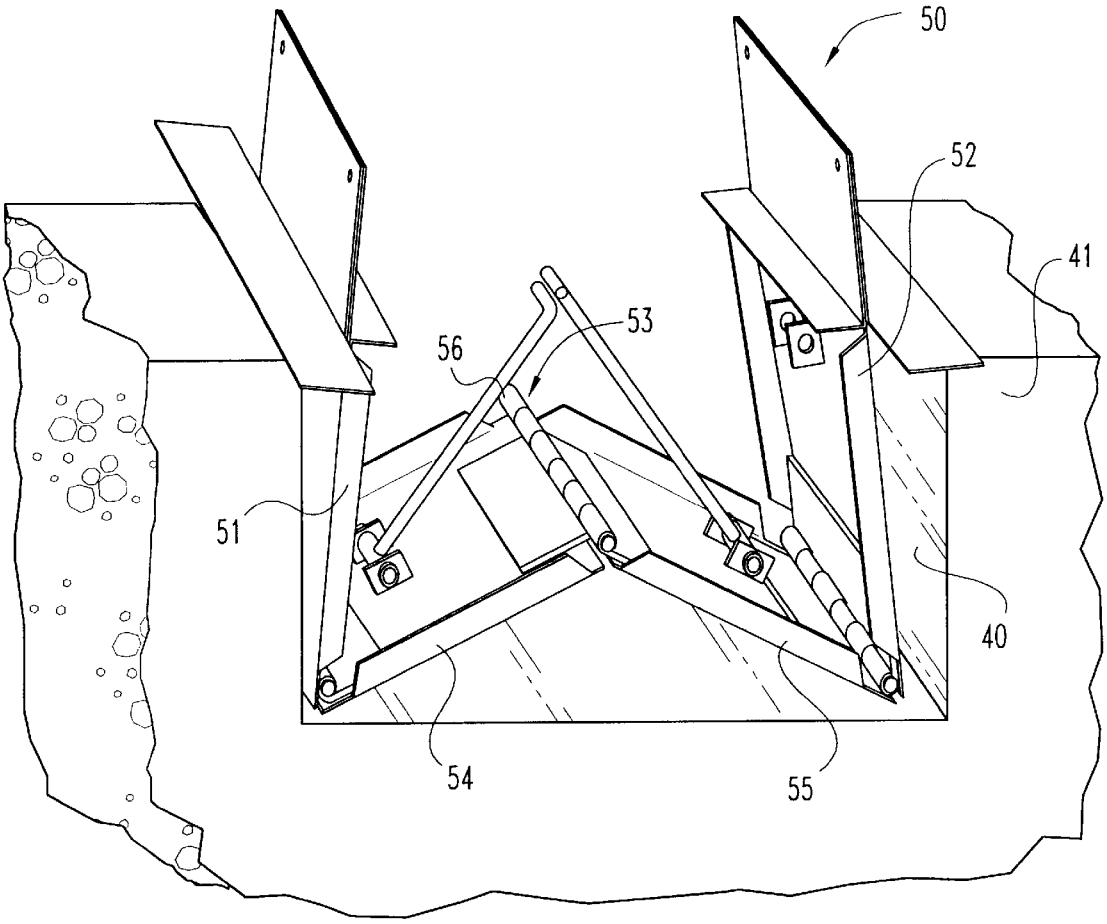
FIG. 6 is a perspective view of the FIG. 5 opening form in a partially contracted state to facilitate removal from the poured wall.

With reference to FIGS. 5 and 6, there is illustrated an alternate embodiment of the opening form for establishing an opening in a wall poured of a flowable building material. The opening form 50 is substantially similar to the opening form 10 and the opening form 30 described above, and like feature numbers will be utilized herein to represent like features in the forms. Opening form 50 is a reusable collapsible form having a first substantially rigid erect mode for preventing the passage of the flowable building material into the volume defined by the form within the space between the first wall form 11 and the second wall form 12 The collapsible form 50 has a second contracted removal mode as illustrated in FIG. 6, that allows for the removal of form 50 from the wall 41. Further, the design and construction of opening form 50 is such that the form is self squaring.

The collapsible form 50 includes a pair of spaced wall members 51 and 52 having a recess forming portion 20 formed thereon. The recess forming portion 20 being formed on the outer surfaces of the wall members to create a groove or recess portion in the opening in the wall. Positioned between the spaced wall members 51 and 52 and coupled thereto is a bottom wall member 53. The bottom wall member 53 abutting each of the end wall members 51 and 52 so as to form a seal to prevent the passage of the flowable building material into the volume 9 when the form 50 is in the substantially rigid erect mode. Further, a pair of hinges 57 and 58, that are coupled between the respective wall members 51, 52 and the bottom wall member 53, provide an additional seal to minimize the passage of the flowable building material into the volume 9.

The bottom wall member 53 having a first portion 54 and a second portion 55 hingedly coupled thereto. A hinge 56 couples the first portion 54 to the second portion 55, and the hinge further functions as a strengtening rib to add stiffness to the bottom wall member 53. Hinge 56 provides an additional seal to minimize the passage of the flowable building material into the volume 9. In the preferred embodiment the hinge 56 is a piano type hinge, however other hinge types are contemplated herein provided they can withstand the demands of the particular application; other hinge types include but are not limited to a fiber hinge, a plurality of spaced hinges, and a living hinge. A hinge 57 substantially similar to hinge 56 is utilized to hingedly couple the first portion 54 to the end wall member 51. Hinge 57 allows for the rotation of the first end wall member 51 relative to the first portion 54. A substantially identical hinge 58 couples the end wall member 52 to the second portion 55. Hinge 58 allows the end wall member 52 to rotate about the second portion 55.

An end wall portion 51*a* and 52*a* of end wall member 51 and 52 extends a very short distance beyond their respective hinges 57 and 58 so as to minimize the forms 50 interference with the wall during the transition of the form 50 from the substantially rigid erect mode to the second contracted removal mode. In one form of the present invention the very short distance is about one quarter (¼) inches. The Bottom wall member 53 having ends 53*a* and 53*b* that extend a very short distance beyond their respective hinges 57 and 58 so as to minimize the forms 50 interference with the wall during the transition of the form 50 from the substantially rigid erect mode to the second contracted removal mode. In one form of the present invention the very short distance that ends 53*a* and 53*b* extend is about one quarter (¼) inches.

A pair of structural struts 59 are removably coupled between each of the end wall members 51 and 52 and the bottom wall member 53 for holding the opening form 50 in the first substantially rigid erect mode. When the collapsible form 50 is in the substantially rigid erect mode, one of the struts 59 extends between each of the end wall members and the bottom wall member 53. In order to remove the collapsible form 50 from the poured wall, the struts 59 are removed from the end wall members so as to decouple them from the bottom wall member 53 and allow the pieces of the collapsible form 50 to be moved inwardly from the substantially rigid erect mode. The form is now disposed in the second contracted removal mode.

Opening form 50 having a removeable brace 70 extending between the inner surfaces of the wall members 51 and 52 to add structural rigidity and for preventing the collapse of the form 50 upon being subjected to the loads associated with wet flowable building material. A brace receiving member 71 is coupled to each wall member 51 and 52 and defines a slot for receiving a respective end 70*a* and 70*b* of the brace 70 therein.

The transitioning of the form 50 from the first substantially rigid erect mode to the second contracted removal mode requires that the struts 59 be disengaged from the end wall members 51 and 52. The struts 59 are than usable as a handle for pulling the bottom wall member 53 upward so as to cause it to fold inwardly as illustrated in FIG. 6. (wall forms 11 and 12 have been removed for clarity) and the end wall members 51 and 52 move inwardly away from the poured wall 41.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An apparatus positionable between a first wall form and a second wall form to create an opening in a wall which is poured of a flowable building material, comprising:

a reusable body member having a pair of spaced outer surfaces extending between the first wall form and the second wall form and a bottom outer surface for preventing the receipt of the flowable building material within a space defined by said reusable body member;

said pair of spaced outer surfaces each having an outwardly extending portion for forming a substantially vertical recess in the wall contiguous with a portion of the opening in the wall; and a supporting member coupled to said body member and extending between the first wall form and the second wall form for suspending said body member from a top of at least one of said first and second wall forms, said supporting member for receiving a clamping load to hold said body member in a substantially fixed position relative to the first and second wall forms during the pouring of the wall.

2. The apparatus of claim 1, wherein said body member is substantially unshaped.

3. The apparatus of claim 2, wherein said pair of spaced outer surfaces are located on a pair of spaced end walls forming a portion of said substantially u-shaped body member, and which further includes a structural member positioned within the body member and spanning between said pair of spaced end walls to prevent the collapse of the apparatus under the load from the flowable building material.

4. The apparatus of claim 3, wherein said bottom outer surface is formed on a bottom wall forming a portion of said substantially u-shaped body member, and said pair of end walls are coupled to said bottom wall, each of said pair of end walls having a first end coupled to said bottom wall and an opposite other second end, and which further includes a structural member holder coupled to each of said pair of end walls for retaining said structural member within said body member, and wherein said apparatus having a first mode wherein said structural member is coupled with said structural member holders and a second mode wherein said structural member is uncoupled from said structural member holders.

5. The apparatus of claim 1, wherein the position of said supporting member is adjustable relative to said bottom outer surface so as to change the body member's vertical position relative to the first wall form and the second wall form, and wherein the flowable building material is concrete.

6. The apparatus of claim 5, wherein said supporting member is attachable to said body member in positions which are offset one hundred and eighty degrees so as to change the body member's vertical position relative to the first and second wall forms, and wherein said supporting member is coupled to the body member by a removable fastener.

7. The apparatus of claim 6, wherein the clamping load is provided by a clamp that engages but does not pass into a portion of said first or second wall forms.

8. The apparatus of claim 6, wherein said body member defines a substantially "U" shape, said pair of spaced outer surfaces and said bottom outer surface forming a contiguous surface for preventing the passage of flowable building material into the space defined by said body member.

9. The apparatus of claim 8, wherein said outwardly extending portion having a substantially rectangular cross section for forming a corresponding opening in the wall for receiving one of a vent, a window frame, and a door frame.

10. An apparatus positionable between a first wall form and a second wall form to create an opening in a wall which is poured of a flowable building material, comprising:

a reusable member having a pair of spaced end walls and a bottom wall extending therebetween, each of said wall is extending between the first and second wall forms for preventing the receipt of the flowable building material within the volume. defined by said reusable member, each of said pair of end walls having an outwardly extending portion adapted for creating a recess as part of the opening in the wall, said bottom wall having a first portion with a first end and an opposite second end and a second portion with a third end and an opposite fourth end and wherein said second and third ends are hingedly coupled together;

a first hinge positioned directly adjacent said first end and one of said pair of end walls and a second hinge positioned directly adjacent said fourth end and the other of said pair of end walls wherein said pair of end walls are hingedly coupled to said bottom wall by the respective first and second hinges;

a supporting member coupled to said reusable member and extending between the first wall form and the second wall form for suspending said reusable member from a top of at least one of the first and second wall forms, wherein said supporting member for receiving a clamping load to hold said reusable member in a substantially fixed position relative to the first and second wall forms during the pouring of the wall; and said reusable member having a substantially rigid opening forming mode for forming the opening in the wall and a contracted mode wherein said pair of end walls and said portions of the bottom wall are disposed inwardly from said opening forming mode for facilitating the removal of the member from the wall.

* * * * *

UNITED STATES PATENT AND TRADEMARK OFFICE

CERTIFICATE OF CORRECTION

PATENT NO : 5,843,324

DATED : December 1, 1998

INVENTOR(S) : Brett L. Shirley

It is certified that error appears in the above-identified patent and that said Letters Patent is hereby corrected as shown below:

Column 6, line 64, please change "unshaped" to --u-shaped--.

Column 8, line 8, please change "wall is" to --walls--.

Column 8, line 10, please change "volume." to --volume--.

Column 8, line 13, please change "wall," to read --wall;--.

Signed and Sealed this

Thirtieth Day of March, 1999

*Attest:*

*Attesting Officer*

Q. TODD DICKINSON

*Acting Commissioner of Patents and Trademarks*